US006105962A

United States Patent [19]

Malavazos et al.

[11] Patent Number: 6,105,962

[45] Date of Patent: Aug. 22, 2000

[54] ROTATING DISKS SLOT MACHINE

[75] Inventors: Alex J. Malavazos; Gregory A. Malavazos; Constantine Malavazos, all of Carson City, Nev.

[73] Assignee: Sierra Design Group, Reno, Nev.

[21] Appl. No.: 09/212,108

[22] Filed: Dec. 15, 1998

[51] Int. Cl.[7] ..... A63F 5/04

[52] U.S. Cl. ..... 273/143 R; 463/20; 273/138.1; 273/138.2; 273/142 R

[58] Field of Search ..... 463/16–20; 273/143 R, 273/138.1, 738.2, 142 R, 141 R, 138 A

[56] References Cited

U.S. PATENT DOCUMENTS

| | | | |
|---|---|---|---|
| 887,464 | 5/1908 | Creasey | 273/280 |
| 1,138,865 | 5/1915 | Hagerty | 273/142 G |
| 1,376,199 | 4/1921 | Gotsche . | |
| 1,474,488 | 11/1923 | Nelson . | |
| 1,537,236 | 11/1925 | Jarvis . | |
| 1,977,814 | 10/1934 | Warner | 273/142 G |
| 2,081,255 | 5/1937 | Troth | 273/142 |
| 3,166,323 | 1/1965 | Anderson | 273/142 R |
| 3,843,131 | 10/1974 | Stubbmann | 273/134 G |
| 3,853,324 | 12/1974 | Reiner | 273/142 E |
| 4,732,386 | 3/1988 | Rayfiel | 273/142 H |
| 5,096,196 | 3/1992 | Gutknecht et al. | 273/142 HA |
| 5,102,135 | 4/1992 | Addiechi | 273/142 E |
| 5,513,846 | 5/1996 | Niederlein et al. | 273/143 R |
| 5,553,851 | 9/1996 | Malavazos et al. | 273/143 E |
| 5,823,874 | 10/1998 | Adams . | |

FOREIGN PATENT DOCUMENTS

| | | | |
|---|---|---|---|
| 5285252 | 11/1993 | Japan | 273/142 HA |
| 6091034 | 4/1994 | Japan | 273/142 HA |
| 2 201 821 | 9/1988 | United Kingdom . | |

*Primary Examiner*—Jessica J. Harrison
*Assistant Examiner*—S Clayton
*Attorney, Agent, or Firm*—Ian F. Burns

[57] ABSTRACT

Gaming apparatus has rotatable disks turning about a common axis of rotation and having annular bands of indicia of different diameters on faces of the disks which extend toward the axis of rotation. A player's winnings are determined by alignment of particular indicia along one or more radii of the disks after a period of rotation. In one form of the invention, the disks are supported, driven and held in a centered relationship with the axis of rotation by gear sets situated at angular intervals around the periphery of the disks which engage gear teeth at the rims of the disks. In another form, the disks are axially spaced apart flat plates of progressively greater diameter extending from drive shafting at the axis of rotation. In another form, the disks are at least partially formed of transparent material enabling viewing of indicia on disks which are behind other disks.

17 Claims, 7 Drawing Sheets

ROTATING DISKS SLOT MACHINE

TECHNICAL FIELD

This invention relates to amusement devices and more particularly to gaming apparatus of the type in which a player's score or winnings is determined by rotatable members which carry indicia and which separately spin about a common axis and then come to rest at any of a plurality of different angular orientations to determine the player's score or winnings.

BACKGROUND OF THE INVENTION

The traditional slot machine has a series of annular reels disposed in side by side relationship that rotate separately about a common axis. Players scores or winnings are indicated by indicia on the peripheral surfaces of the reels which may align in any of a number of different combinations following a period of rotation of the reels. Players of gaming apparatus typically find it enjoyable to have a variety of different forms of gaming apparatus available. For this purpose, slot machines of the spinning reel type have been provided with a variety of different graphics, cabinet configurations and other varied embellishments such as varying visual or sound effects and differing scoring systems for example. Modification of slot machines of this kind to enhance player enjoyment are circumscribed if the above described basic geometry of mechanical components of the apparatus is retained. The side by side reel arrangement has in the past imparted an undesirable degree of similarity to slot machines of this type notwithstanding the superficial variations of the above described kind.

It has heretofore been proposed to make a basic change in the geometry of the slot machine by replacing the side by side reels with concentric rotating disks which turn about a common axis and which face the operator of the slot machine. Annular bands of differing indicia on faces of the disks are of progressively greater diameter. A player's score is determined by alignment of particular combinations of the indicia along a payline which extends radially relative to the axis of rotation of the disks. As heretofore envisioned, slot machines of this kind have required an undesirably complex construction in order to support and drive the disks and to position the faces of the disks in a coplanar relationship.

The present invention is directed to overcoming one or more of the problems discussed above.

SUMMARY OF THE INVENTION

In one aspect, the present invention provides gaming apparatus having a plurality of rotatable disks centered on a common axis of rotation, each disk being separately rotatable about the axis of rotation. Each disk has an annular band of indicia thereon which encircles the axis of rotation. A player's score is determined by arrival of particular indicia at particular locations following a period of rotation of the disks. The band of indicia of each disk is on a face of the disk which extends inward towards the axis of rotation. Each disk has a peripheral region which is of greater diameter than the band of indicia on the disk and each has an annular band of gear teeth at the peripheral region of the disk which band of gear teeth is centered on the axis of rotation. Each band of gear teeth is engaged by a separate one of a plurality of drive gears and a separate one of a plurality of drive motors is coupled to each drive gear to turn the gear.

In another aspect of the invention, the gaming apparatus further includes a plurality of disk positioning gear sets situated at the peripheries of the rotatable disks at angular intervals around the axis of rotation thereof. Each gear set includes a motor driven shaft with one of the drive gears being on the shaft and being rotated thereby and a plurality of idler gears on the driven shaft which are rotatable relative to the shaft. The drive gear of each gear set engages the gear teeth of a separate one of the rotatable disks. The idler gears of each gear set engage the teeth of the ones of the rotatable disks that are not engaged by the drive gear of the gear set. Thus the gear sets at the peripheries of the rotatable disks support and position the disks in addition to driving the disks.

In another aspect the invention provides gaming apparatus having a plurality of disks which are centered on a common axis of rotation, each disk being separately rotatable about the axis of rotation. Each disk has an annular band of indicia thereon which encircles the axis of rotation, the indicia being on faces of the disks which extend inward towards the axis of rotation. A player's score is determined by arrival of particular indicia at particular locations following a period of rotation of the disks. Each disk is supported by a separate one of a plurality of telescoped drive shafts which extend along the axis of rotation and a separate drive motor is coupled to each of said drive shafts. The faces of the disks at which the bands of indicia are located are spaced apart in a direction parallel to the axis of rotation.

In still another aspect, the invention provides gaming apparatus having a plurality of rotatable members which are centered on a common axis of rotation, each of the rotatable members being separately rotatable about the axis of rotation. Each rotatable member has an annular band of indicia thereon which encircles the axis of rotation and a player's score is determined by arrival of particular indicia at particular locations following a period of rotation of the rotatable members. The annular band of indicia of each rotatable member is on a face of the member which extends inward towards the axis of rotation from the perimeter of the member. The annular bands of indicia of the rotatable members are of differing diameters and portions of at least one rotatable member are in front of the annular band of indicia of another rotatable member. At least the portions of a rotatable member that are in front of the annular band of indicia of another rotatable member are formed of transparent material.

The invention is applicable to a form of gaming apparatus which enhances players enjoyment as it has a configuration that is distinctly different from traditional slot machines in which indicia are situated on side by side reels. The player views the faces of rotating disks rather than the peripheral surfaces of side by side reels. Indicia align radially relative to the axis of rotation rather than in parallel relation to the axis of rotation as in the traditional slot machine. The general appearance of the moving components during operation is distinctly different from that of the traditional slot machine. These factors create an intriguing ambiance for players of slot machines. The invention provides a simplified and advantageous construction for the disks and disk support, positioning and driving mechanism in gaming apparatus of this kind.

The invention, together with further aspects and advantages thereof, may be further understood by reference to the following description of the preferred embodiments and by reference to the accompanying drawings.

DETAILED DESCRIPTION OF THE PREFERRED EMBODIMENTS

Figure 1:
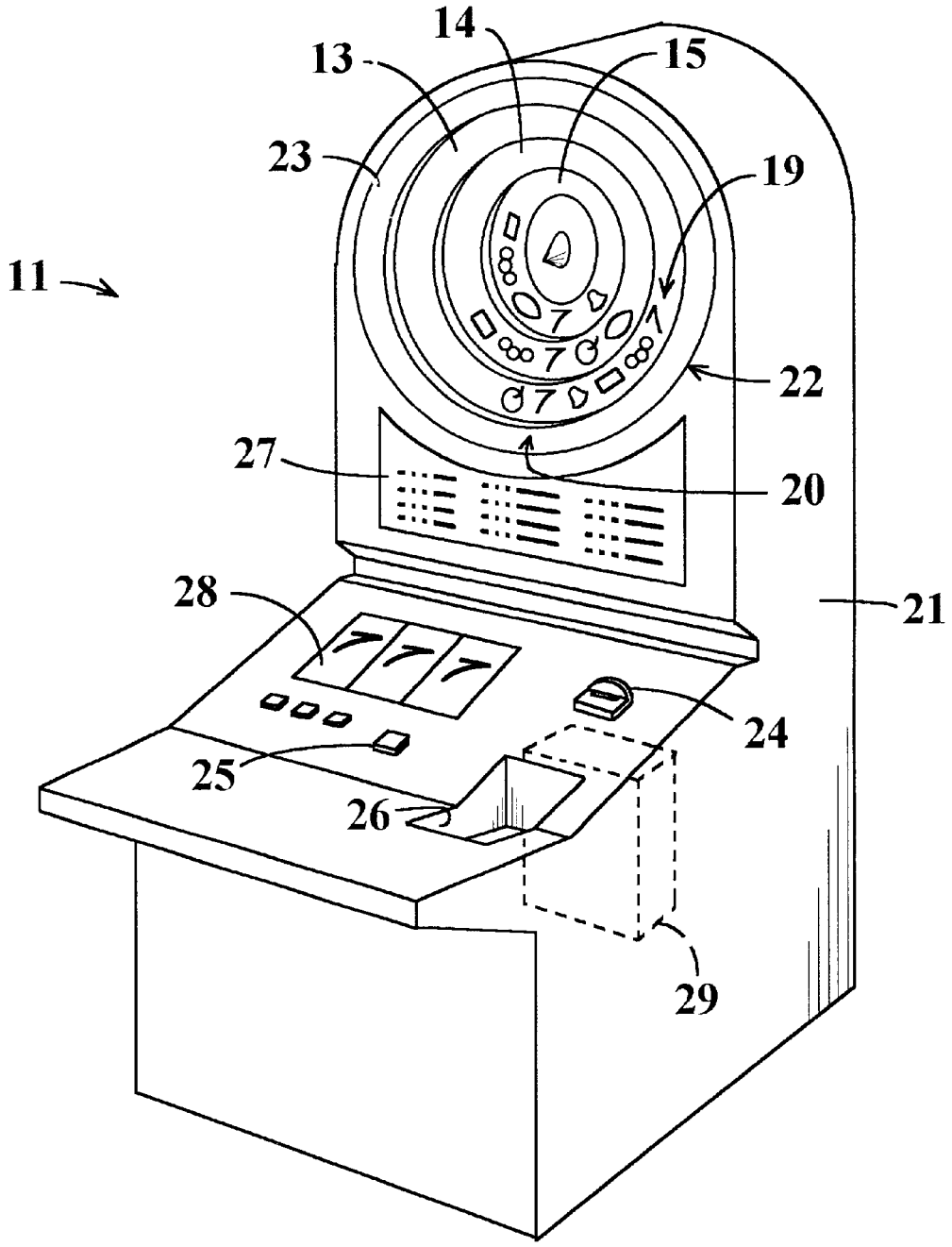
FIG. 1 is a perspective view of a slot machine embodying the invention.
Figure 2:
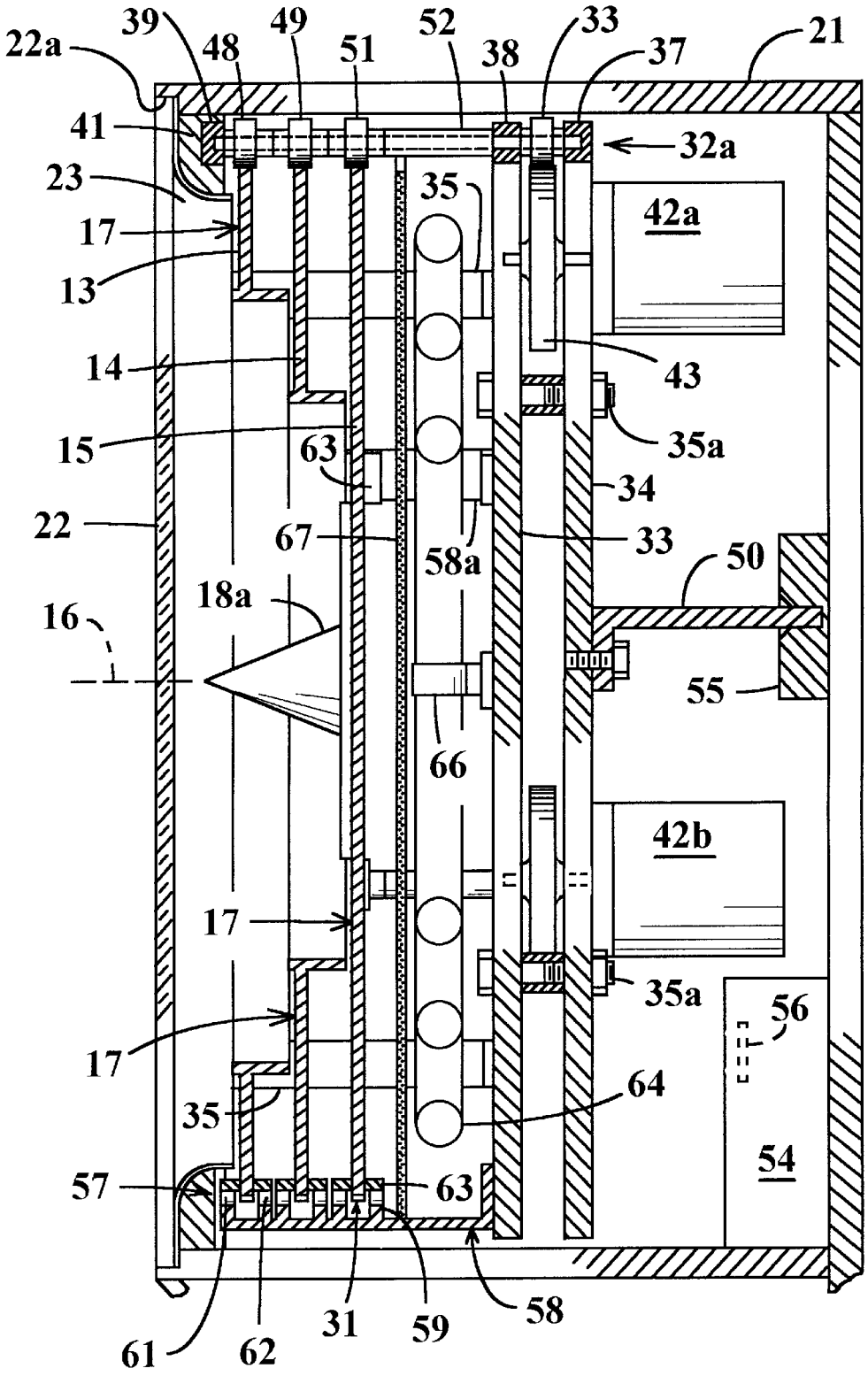
FIG. 2 is an elevation section view of the upper portion of the apparatus of FIG. 1 taken along the axis of rotation of rotary components of the apparatus.

Referring initially to FIGS. 1 and 2 of the drawings, a slot machine 11 in accordance with the first embodiment of the invention has a plurality of rotatable disks which in this example include a front disk 13, an intermediate disk 14 and a rear disk 15 which turn about a common axis of rotation 16 and which have front surfaces 17 which extend inward from the peripheries of the disks towards the axis of rotation. The disks 13, 14 and 15 of this example have similar outer diameters. The front disk 13 is annular with an open center defined by a hub portion 18 of the disk from which the front surface 17 extends in a radially outward direction. Intermediate disk 14 is also annular and has a hub portion 18 of smaller diameter than the hub portion of the front disk 13. The rear disk 15 of this example is a flat plate which has no center opening and a conical projection 18*a* extends from the center of the plate for decorative reasons. These disk configurations enable viewing of an annular region of the front surface 17 of each of the disks by a player who is situated in front of the slot machine 11.

Indicia 19 are imprinted on the visible annular regions 17 of each of the disks 13, 14 and 15 and are arranged in annular bands of indicia which are centered on the axis of rotation 16, which are of progressively increasing diameter and which are preferably adjacent to or close to each other in the radial direction on the disks. Individual indicia 19 of each of the disks 13, 14 and 15 are spaced at equal angular intervals around the axis of rotation 16. The indicia 19 of each disk 13, 14 and 15 are of a plurality of different designs. The designs may, for example, be the traditional bars, bells, cherries, plums and the like that are found on many prior slot machines or may be other symbols, such as numerals or letters that are distinct from each other. As in other slot machines, a players winnings or score if any is determined by the particular indicia 19 that come to rest or into alignment at a particular location following a period of rotation of the bands of indicia. In contrast to the traditional reel type of slot machine, the payline 20 at which such alignments occur extends radially relative to the axis of rotation 16 rather than in parallel relationship with the axis of rotation. In further contrast to a traditional slot machine, it is possible to have more than one payline 20 as all of the indicia 19 can be visible to the player at the same time.

The disks 13, 14 and 15 of this example are housed in a cabinet 21 behind a transparent circular window 22 of the cabinet. The outermost regions of the disks 13, 14 and 15 are concealed by an annular bezel member 23 situated immediately behind the window 22 and which curves rearwardly towards the front disk 13. Referring to FIG. 1 in particular, the slot machine 11 may have a coin receiver 24, a start play switch button 25 and an open coin payout chamber 26. Coin receiver 24 may be replaced with or supplemented by a paper currency or charge card validator and the button switch 24 may be replaced with or supplemented by a switch that is operated by manually pivoting an arm in the manner of the traditional slot machine. A display window 27 situated below the visible portions of the disks 13, 14 16 or elsewhere may display winning combinations of indicia to the player. An electronic display screen 28 of the kind which produces changeable images may be provided on the front of cabinet 21 to display winning combinations of indicia when they occur. The coin receiver 24 and coin processing mechanism 29 may be of one of the known forms. Switch button 25 and the electrical components of the slot machine 11 which respond to operation of the switch may also be of conventional form except as hereinafter described. The slot machine 11 may be embellished with lights, bells and/or other visual and audio effects in the manner known to the art.

Figure 3:
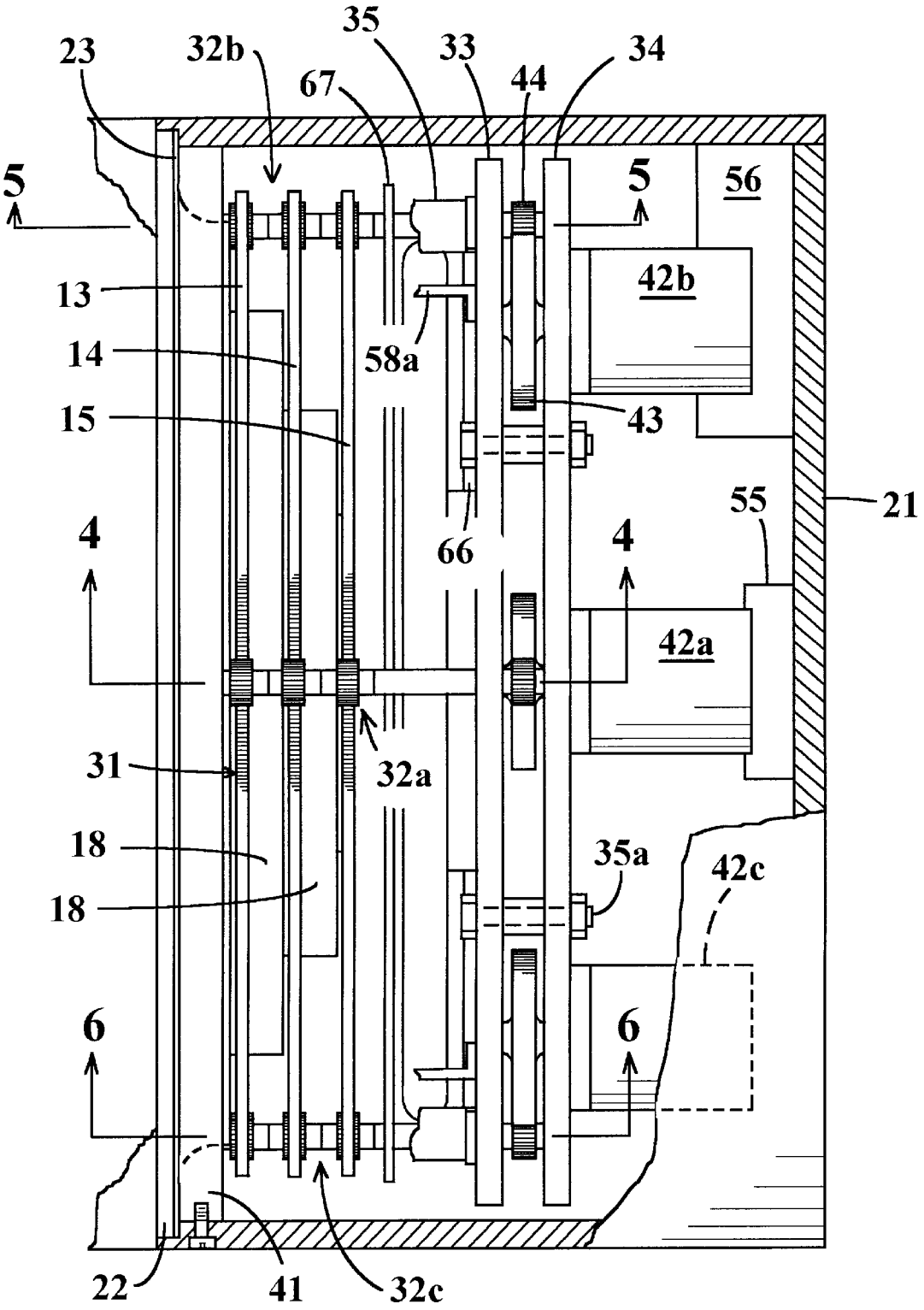
FIG. 3 is a broken out top view of the upper portion of the slot machine of FIG. 1.

Referring jointly to FIGS. 2 and 3, the periphery of each of the rotatable disks 13, 24 and 15 is provided with gear teeth 31. The disks 13, 14 and 15 are positioned, supported and driven by a compact and simple mechanism which includes three gear sets 32*a*, 32*b* and 32*c* which engage the gear teeth 31. The gear sets 32*a*, 32*b* and 32*c* are situated adjacent to the peripheral region of the disks 13, 14 and 15 and are angularly spaced apart relative to the axis of rotation 16 of the disks. The angular interval between the gear sets 32*a*, 32*b* and 32*c* around the axis of rotation 16 is less than 180° for reasons which will hereinafter be discussed and is preferably 120° as in this particular example of the invention.

Figure 4:
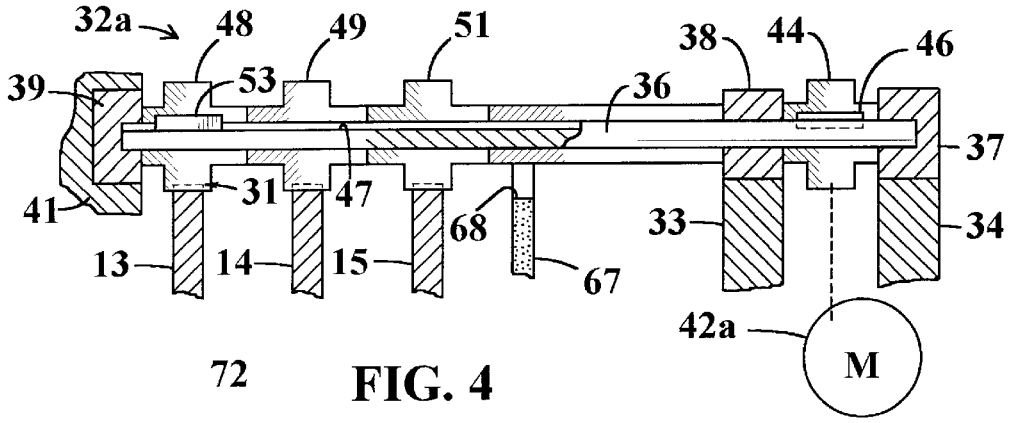
FIG. 4 is a section view taken along line 4—4 of FIG. 3 and which depicts a first gear set of the slot machine.

A pair of spaced apart circular support plates, including a forward support plate 33 and rear support plate 34, extend vertically within the upper region of cabinet 21 behind the rotatable disks 13, 14 and 15. Bolts 35 secure the two support plates together. Referring jointly to FIGS. 2 and 4, each of the gear sets 32*a*, 32*b* and 32*c* has a rotatable drive shaft 36 which extends from a back end bearing 37 mounted in the rear support plate 34 through a bushing 38 mounted in the forward support plate 33 to a front end bearing 39 mounted in an annular front structural member 41 which is situated immediately behind the bezel 23 and which has an open center to enable viewing of the disks 13, 14, 15. The drive shaft 36 of each gear set 32*a*, 32*b* and 32*c* is driven by a separate one of three electric motors 42*a*, 42*b* and 42*c* which are situated behind the rear support plate 34 and secured to that support plate. Each such motor 42*a*, 42*b* and 42*c* turns a motor output gear 43 situated between the forward and rear support plates 33 and 34 and which engages a smaller driven gear 44 situated on the drive shaft 36 of the associated one of the gear sets 32*a*, 32*b* and 32*c* at a location between the support plates. The drive shafts 36 are constrained to rotate with the driven gears 44 in this example by keys 46 within the driven gears which seat in longitudinal keyway slots 47 that extend along each drive shaft. Alternately, the driven gears 44 may be locked to the drive shafts 36 by set screws or other means known to the art.

Figure 5:
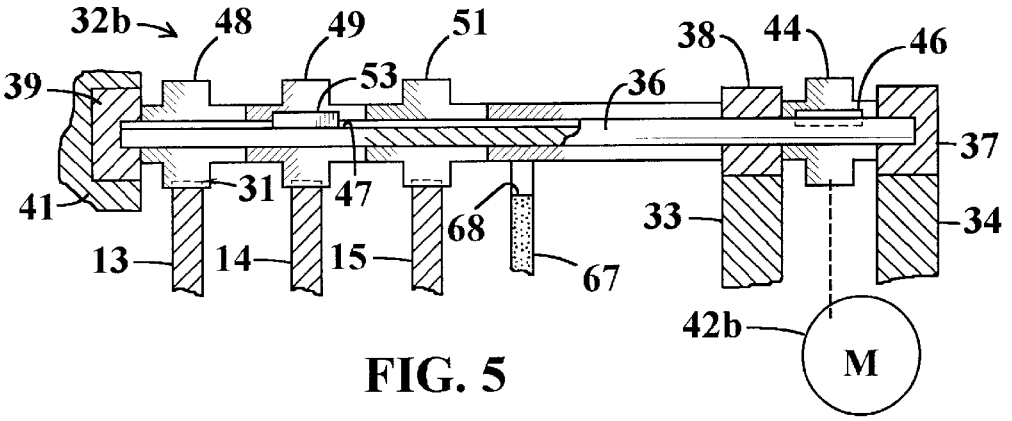
FIG. 5 is a section view taken along line 5—5 of FIG. 3 and which depicts a second gear set of the slot machine.
Figure 6:
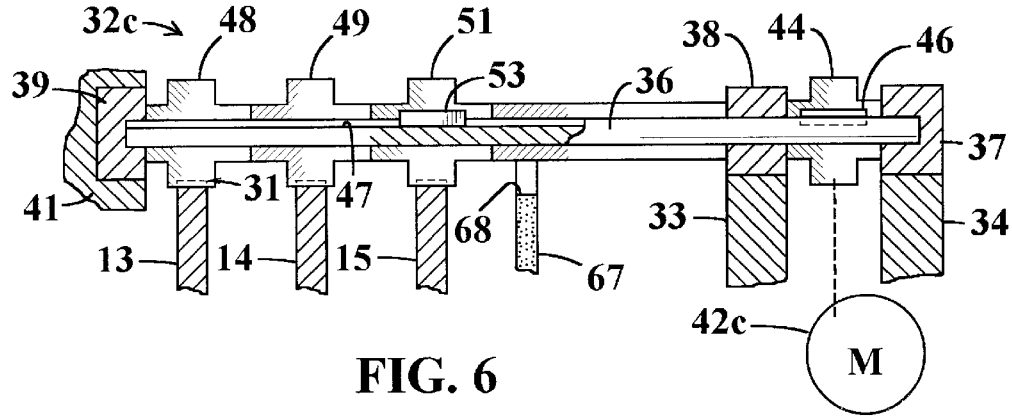
FIG. 6 is a section view taken along line 6—6 of FIG. 3 and which depicts a third gear set of the slot machine.

Referring to FIGS. 4, 5 and 6 in conjunction, each of the gear sets 32*a*, 32*b* and 32*c* has three disk support gears disposed along the drive shaft 36 including a front support gear 48, an intermediate support gear 49 and a rear support gear 51. The front support gear 48 engages the teeth 31 of front rotatable disk 13, intermediate support gear 49 engages the teeth 31 of intermediate rotatable disk 14 and the rear support gear 51 engages the teeth 31 of the rear rotatable disk 15. The support gears 48, 49 and 51 are of equal outer diameter in this example of the invention and are proportioned to abut against each other. A tubular sleeve 52 is disposed on each drive shaft 36 in coaxial relationship therewith and extends between bushing 38 and the rear support gear 51 to hold the support gears at the locations along the shaft at which they engage the rotatable disks 13, 14 and 15.

Provided that the angular interval between successive ones of the three gear sets 32*a*, 32*b* and 32*c* around the axis of rotation of the rotatable disks 13, 14 and 15 is less than 180° as previously described, the support gears 48, 49 and 51 act to hold each of the disks in a centered relationship relative to the axis of rotation. The gear sets 32*a*, 32*b* and 32*c* also function to rotate each of the disks 13, 14 and 15. In particular as shown in FIG. 4, at gear set 32*a* the front support gear 48 is constrained to rotate with drive shaft 36 by an internal key 53 which seats in the drive shaft keyway slot 47. The other two support gears 49 and 51 at gear set 32*a* are idler gears which are free to rotate relative to the drive shaft 36. Thus the first gear set 32*a* both supports and drives the front rotatable disk 13 while serving only as a support for the other rotatable disks 14 and 15.

At the second gear set 32*b*, as shown in FIG. 5, it is the intermediate support gear 49 that is constrained to rotate with drive shaft 36 by an internal key 53 while the front and rear support gears 48 and 51 are idler gears that may turn relative to the shaft. Thus the second gear set 32*b* drives the intermediate rotatable disk 14 while also serving as a support for the other two rotatable disks 13 and 15.

With reference to FIG. 6, at the third gear set 32*c* the rear support gear 51 is constrained to rotate with drive shaft 36 by an internal key 53 with the front and intermediate support gears 48 and 49 being free turning relative to the shaft. Accordingly the third gear set drives the rear rotatable disk 15 while functioning as a support for the other two rotatable disks 13 and 14.

Referring again to FIGS. 2 and 3, the disks and disk support and drive mechanism are unitized by connectors 35 which extend from the annular front structural member 41 to the circular front support plate 33 and the assembly has a maximum diameter that enables insertion and withdrawal of the unitized mechanism through the window opening 22*a* at the front of cabinet 21 upon removal of the window 22 itself. This facilitates assembly and repairing of the slot machine. The unitized mechanism is positioned at its back end by a support bracket 50 which extends from rear support plate 34 into a socket 55 which is secured to the rear wall of cabinet 21.

With continued reference to FIGS. 2 and 3, the disk drive motors 42*a*, 42*b* and 42*c* are preferably controlled by a microprocessor circuit, contained within a circuit housing 54, which may be of the known design that is commonly used in conventional modern slot machines. The motors 42*a*, 42*b* and 42*c* are brake gear motors of the known stepping form which separately rotate each disk 13, 14 and 15 through a predetermined number of angular increments that is determined by the control circuitry and which varies during successive playings of the slot machine 11. Referring again to FIG. 1, the angular increment through which each disk 13, 14 and 15 is traveled during each step of the rotary movement corresponds to the angular spacing of the centers of successive ones of the indicia 19 about the axis of rotation of the disks. Thus indicia 19 of each disk 13, 14 and 15 are in alignment along radii of the axis of rotation when the motors stop turning the disks. The presence of particular indicia 19 or combinations of indicia at payline 20 at that time determines the player's winnings or score in the conventional manner.

Slot machine motor control circuits 54 which are microprocessor controlled require tracking of the rotary movement of the indicia carrying rotatable members by the microprocessor 56. For this purpose, tracking means 57 are provided for generating repetitive electrical signal pulses including first, second and third series of pulses each of which is indicative of rotary motion of a separate one of the rotatable disks 13, 14 and 15. Successive pulses in each series are produced in response to successive increments of rotary motion of the disk 13, 14 or 15 that is being tracked by the particular series. In a manner known to the art, this enables the microprocessor 56 to cause stopping of rotation of the members at times when indicia are in alignment at the payline and, by counting the pulses, to determine which indicia are at the payline.

The tracking means 57 of this example of the invention operates by photoelectric sensing of disk motion. Means 57 includes a bracket 58 which extends forward from the front circular support plate 33, past the peripheries of each of the rotatable disks 13, 14 and 15, and into the front structural member 41. Bracket 58 has pairs of spaced apart tangs 59 and the tangs of each pair extend along opposite sides of the gear teeth 31 of a separate one of the rotatable disks 13, 14 and 15. One tang 59 of each pair supports a small light source 61 positioned to direct light towards a light detector 62 supported by the other tang of the pair and which is at the other side of the gear teeth 31 of the disk 13, 14 or 15 which extends between the pair of tangs. The light sources 61 may be of any of a variety of types such as light emitting diodes for example. The light detectors 62 may also be of any of a variety of different types, phototransistors and photodiodes being examples.

The gear teeth 31 of each rotatable disk 13, 14 and 16 repetitively pass through the light path between the associated light source 61 and light detector 62. This causes the output signal of the detector 62 to switch repetitively between a high condition and a low condition thereby providing the desired series of rotary motion tracking signal pulses. For reasons to be hereinafter described, the rotatable disks 13, 14 and 15 in their preferred form are made of translucent material. In instances where this results in an undesirably small variation of the light detector 62 outputs in response to the passage of gear teeth 31, the sides of the gear teeth can be coated with paint or other opaque material. It is also possible to situate the light sources 61 and detectors 62 at locations which are closer to the axis of rotation than the peripheral gear teeth 31. The disks 13, 14 and 15 may then be provided with bands of light passages separated by relatively opaque areas that travel between the light sources 61 and light detectors 62 as the disks turn.

Movement of the rotatable disks 13, 14 and 15 in a direction parallel to the axis of rotation 16 is prevented by pads 63 which are secured to the ends of the tangs 59 of bracket 58. The pads 63 are preferably formed of a low friction resilient material such as felt. The pads 63 at each pair of tangs 59 extend towards and bear against the sides of the disk 13, 14 or 15 which extends between that pair of tangs. A pair of similar brackets 58*a* and 58*b* having pads 63 extend from the front circular support plate 33 to restrain axial movement of the rotatable disks 13, 14 and 15 at additional locations which are angularly spaced apart around the axis of rotation 16 of the disks. The brackets 58, 58*a* and 58*b* of this particular example of the invention are at 120° angular intervals around the axis of rotation 16.

Referring jointly to FIGS. 1 and 2, the hereinbefore described configuration of the rotatable disks 13, 14 and 15 causes the indicia carrying surfaces 17 of the three disks to be at progressively greater distances from the player of the slot machine 11. This creates a three dimensional effect that enhances player enjoyment of the gaming apparatus. This can be further enhanced by pulsed illumination at the three indicia displaying surfaces 17. To enable such illumination, the disks 13, 14 and 15 are formed of translucent plastic or other translucent material. Referring jointly to FIGS. 2 and 3, three concentric circular fluorescent light tubes 64 are situated behind the disks 13, 14 and 15, the tubes being secured to the front circular support plate 33 by brackets 66. The fluorescent light tubes 64 are centered on the axis of rotation 16 of disks 13, 14 and 15 and have differing diameters. The outermost tube 64 has a diameter corresponding to the diameter of the indicia bearing surface 17 of the front disk 13, the middle tube 64 has a diameter corresponding to the diameter of the indicia bearing surface 17 of the intermediate disk 14 and the diameter of the innermost tube 64 corresponds to the diameter of the indicia bearing surface of the rear disk 15.

A light diffuser plate 67 extends between the fluorescent light tubes 64 and the rear rotatable disk 15 to provide for a more uniform illumination of the indicia bearing surfaces 17 of the disks. The diffuser plate 67 is supported by the previously described brackets 58, 58*a* and 58. As best seen in FIGS. 4, 5 and 6, the rim of diffuser plate 67 has notches 68 to enable gear sets 32*a*, 32*b* and 32*c* to be situated at their previously described locations.

Referring again to FIGS. 1 and 2, strobing of the fluorescent lights 64 on and off attracts the attention of potential players of the slot machine 11 and contributes to player interest during playing of the game. Rapid sequential strobing of the three lights 17 enhances the three dimensional aspect of the indicia display at the face of the slot machine.

The example of the invention described above with reference to FIGS. 1 to 6 embodies a highly advantageous mechanism for supporting and driving the indicia carrying rotatable disks 13, 14 and 15. Both functions, supporting and driving, are effected with simple gear sets situated at the periphery of the disks. This eliminates the complex and bulky telescoped shafting and other components at the axis of rotation of the disks which has heretofore been present in slot machines of this general type. The rim drive also makes it possible to include open centered rotating disks which need not extend to the axis of rotation thereby enabling viewing of indicia bands of progressively smaller diameter that are spaced apart along the axis of rotation of the disks. The disk support and drive mechanism in the preferred form is easily removable from the slot machine cabinet as a unit to facilitate repairs.

Figure 7:
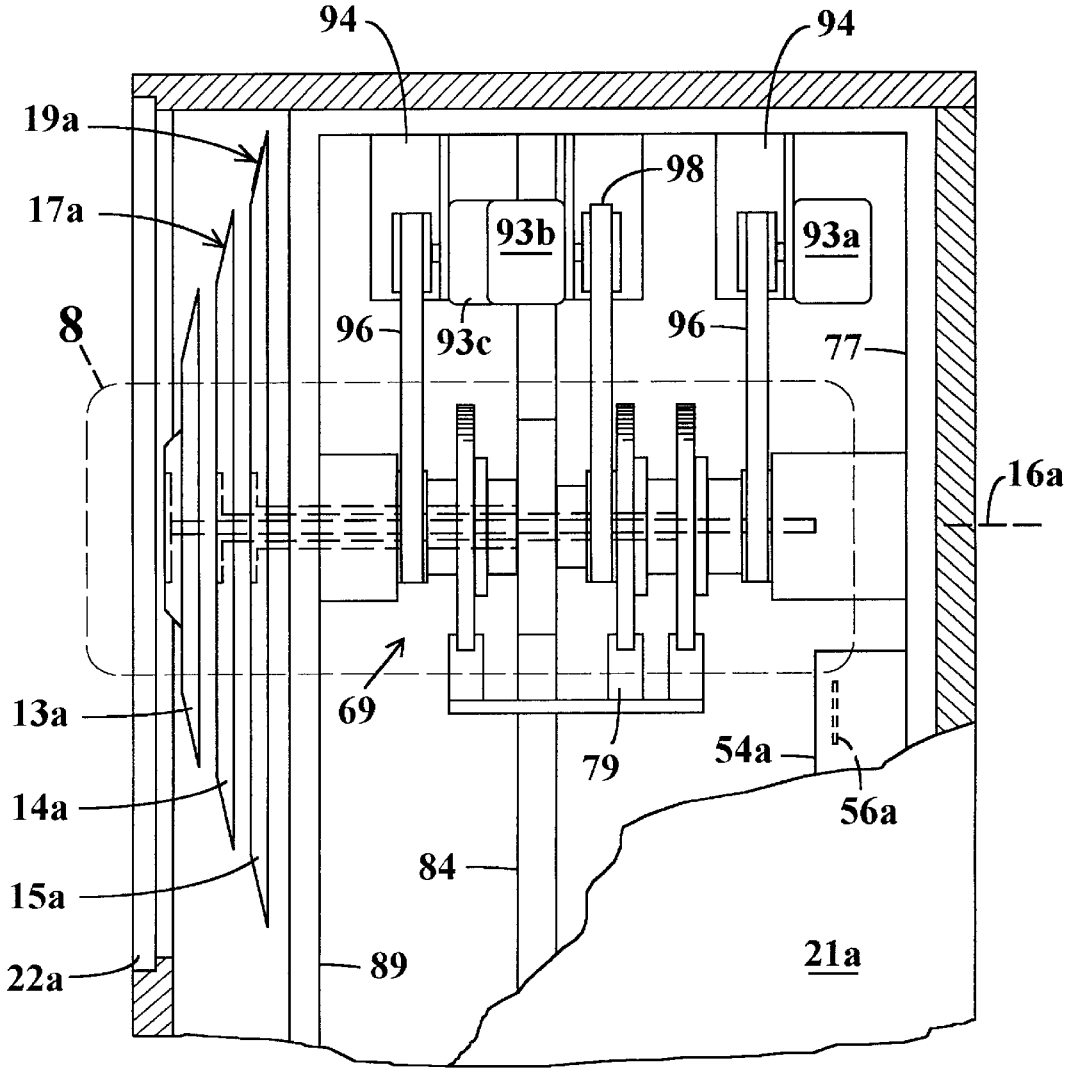
FIG. 7 is a broken out side view of the upper portion of a slot machine showing a second embodiment of the invention.
Figure 8:
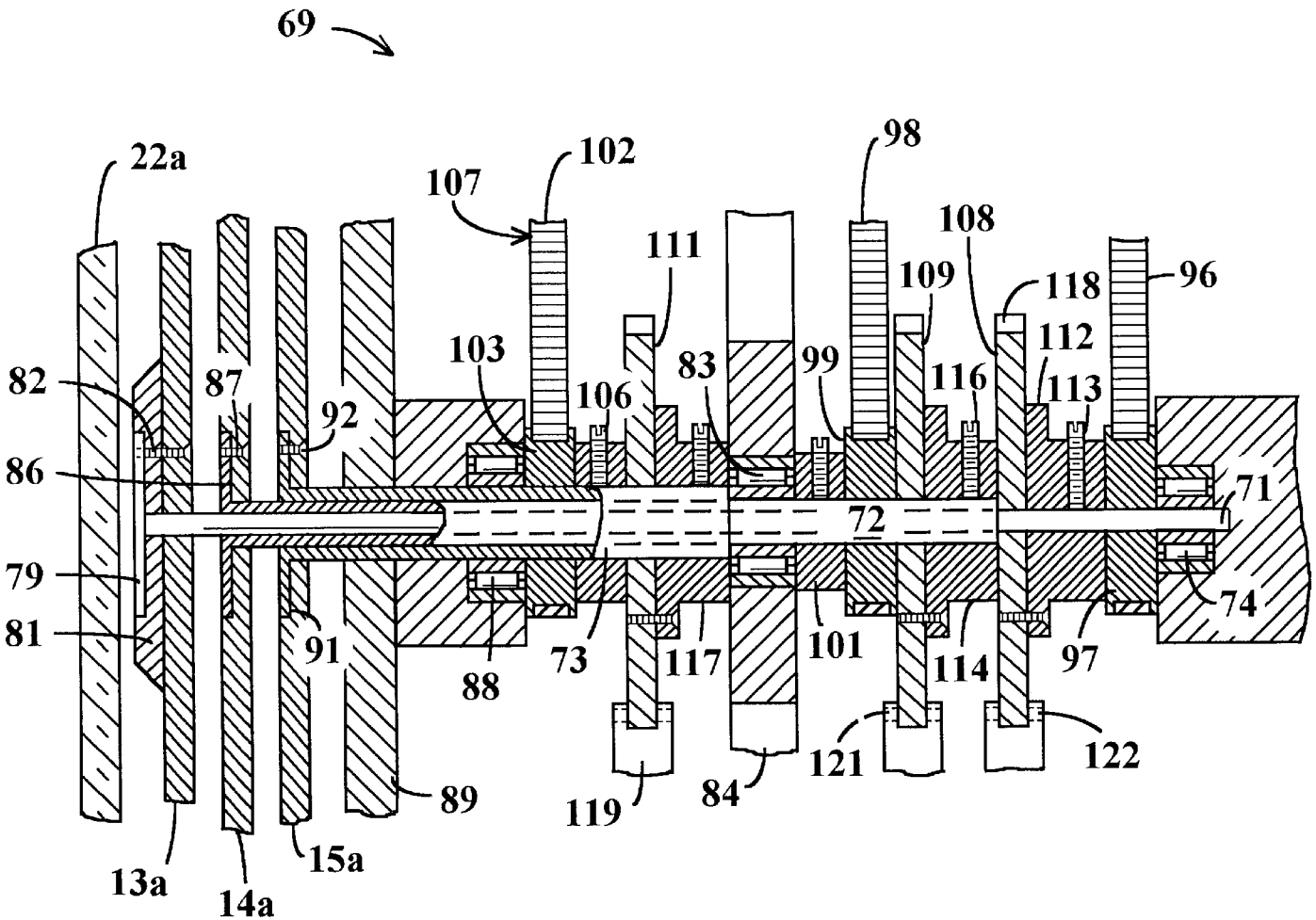
FIG. 8 is a vertical section view of the portion of the mechanism of FIG. 7 that is enclosed by dashed line 8 thereof.

While the rim driven construction discussed above constitutes the preferred form of the invention, certain novel features of the previously described embodiment can advantageously be embodied in rotating disk slot machines which have center shafting for the purpose of supporting and driving the disks. This includes, for example, axial spacing of the rotating bands of indicia to provide a three dimensional aspect to the indicia array as viewed by the player. FIGS. 7 and 8 depict the disks and disk support and drive mechanism of a slot machine 11*b* of this kind.

Referring jointly to FIGS. 7 and 8, front, intermediate and rear rotatable disks 13*a*, 14*a* and 15*a* respectively, of this embodiment are flat circular plates which are spaced apart along a common axis of rotation 16*a*. The disks 13*a*, 14*a* and 15*a* have progressively greater outside diameters thereby enabling viewing of an annular region 17*a* of the front surface of each of the disks by a player who situated in front of the slot machine which regions are at the radially outermost portions of the disks. Annular bands of indicia 19*a* of the previously described kind are imprinted on the regions 17*a* of the disks. An interesting effect is created if the annular regions 17*a* of the disks 13*a*, 14*a* and 15*a* are beveled surfaces so that the indicia 19*a* of the three disks are in a coplanar or near coplanar relationship.

Rotatable disks 13*a*, 14*a* and 15*a* are supported and separately rotated by a drive system 69 which includes three coaxial drive shafts 71, 72 and 73 of progressively shorter length. The back end of the inner drive shaft 71 extends out of intermediate drive shaft 72 and is supported by a first bearing 74 which is secured to one arm 76 of internal framing 77 within the slot machine cabinet 21*a*. The front end of inner drive shaft 71 also extends out of the intermediate drive shaft 72 and has a flange 79 seated in a conforming opening in a circular cap 81 which is in front of the front disk 13*a*. Screws 82 extend through the front disk 13*a* and cap 81 and engage in flange 79 thereby constraining the disk to rotate with the inner drive shaft.

A second bearing 83, supported by another framing arm 84, supports the intermediate drive shaft 72 at a location which is forward from the back end of the drive shaft 72. A flange 86 at the front end of intermediate drive shaft 72 seats in a conforming opening in the intermediate rotatable disk 14*a* and is secured to that disk by additional screws 87. The outer drive shaft 73 is supported at an intermediate location along the drive shaft by a third bearing 88 which is secured to another arm 89 of the cabinet framing 77. A flange 91 at the front end of the outer drive shaft 73 seats in a conforming opening in the rear rotatable disk 15*a* and screws 92 secure the rear disk to the flange.

Front rotatable disk 13*a*, intermediate rotatable disk 14*a* and rear rotatable disk 15*a* are driven by separate electrical motors 93*a*, 93*b* and 93*c* respectively, motor 93*c* being behind motor 93*b* as seen in FIG. 7. The motors 93*a*, 93*b* and 93*c* are secured to brackets 94 which extend from framing 77. Referring again to FIGS. 7 and 8 in conjunction, motor 51 is coupled to the inner drive shaft 71 by a drive belt 96 which engages a pulley 97 that is keyed to the inner drive shaft at a location adjacent to bearing 74. Another drive belt 98 couples motor 93*b* to the intermediate drive shaft 72 by engaging another pulley 99 which is keyed to the intermediate drive shaft at a location which is between bearings 74 and 83. An annular collar 101 on intermediate drive shaft 72 extends between pulley 99 and bearing 83 to prevent movement of the pulley along the shaft. The third motor 93*c* is coupled to outer drive shaft 73 by a third drive belt 102 which engages another pulley 103 that is keyed to the outer drive shaft at a location immediately behind the third bearing 88. Another annular collar 104 is adjacent to pulley 103 and is held in place by a set screw 106 to prevent axial movement of the pulley along the shaft. Drive belts 96, 98 and 102 are preferably of the non-slip type which have teeth 107 that engage conforming grooves in the pulleys on which they are engaged.

Motors 93*a*, 93*b* and 93*c* are brake gear motors of the stepping type similar to those of the previously described embodiment of the invention and function in a similar manner to rotate each disk 13*a,* 14*a* and 15*a* through a predetermined number of angular increments that is determined by the control circuit 54*a*.

Three circular timer plates 108, 109 and 111 enable microprocessor tracking of the rotary movement of the disks 13*a,* 14*a* and 15*a* in the previously described manner. Timer plate 108 is disposed in coaxial relationship with inner drive shaft 71 at a location between pulleys 97 and 99 and is secured to an adjacent annular collar 112 which is constrained to rotate with the inner drive shaft by a set screw 113. Timer plate 109 is disposed on intermediate drive shaft 73 in coaxial relationship therewith at a location between timer plate 108 and pulley 99 and is secured to another annular collar 114 which is constrained to rotate with the intermediate drive shaft by another set screw 116. The third timer plate 111 is situated between pulley 103 and bearing 83, in coaxial relationship with the outer drive shaft 73, and is constrained to rotate therewith by another annular collar 117.

The circular rim of each of the timer plates 108, 109 and 111 is indented by a series of notches 118 which have an angular spacing relative to the axis of rotation that corresponds to the hereinbefore described angular increment of rotary motion of the disks 13*a,* 14*a* and 15*a*. A separate one of three photoelectric sensors 119 is disposed at the rim of each timer plate 108, 109 and 111 and may be of one of the known types which have a small light source 121 such as a light emitting diode for example and a light detector 122 such as a phototransistor for example that produces an electrical signal in response to light from the source. The light sources 121 and detectors 122 are at opposite sides of the rims of the timer plates 108, 109 and 111 at which notches 118 are located thereby causing light to be transmitted from the sources 121 to the detectors 122 each time that a notch passes between the two. Thus each sensor transmits an electrical pulse to the control circuit housing 54*a* each time that the associated timer plate 108, 109 or 111 is stepped through the above described angular increment of motion by the associated drive motor 93*a,* 93*b* or 93*c*. As previously described, this enables the microprocessor 56*a* to cause stopping of the rotation of the disks 13*a,* 14*a* and 15*a* at times when indicia are in alignment at the payline and, by counting the pulses, to determine which indicia are at the payline.

Components of the slot machine 11*a* of FIGS. 7 and 8 which are not depicted therein may be similar to those of the previously described embodiment of the invention.

The invention is not limited to slot machines of the motor driven, microprocessor controlled type. Pulleys 56, 58 and 61 may, for example, be spun manually by the player preferably with lever arm operated mechanism of the kind found in older forms of slot machine. Embodiments of the invention of this kind do not necessarily require timer plates 68, 69 and 71 and sensors 79.

Figure 9:
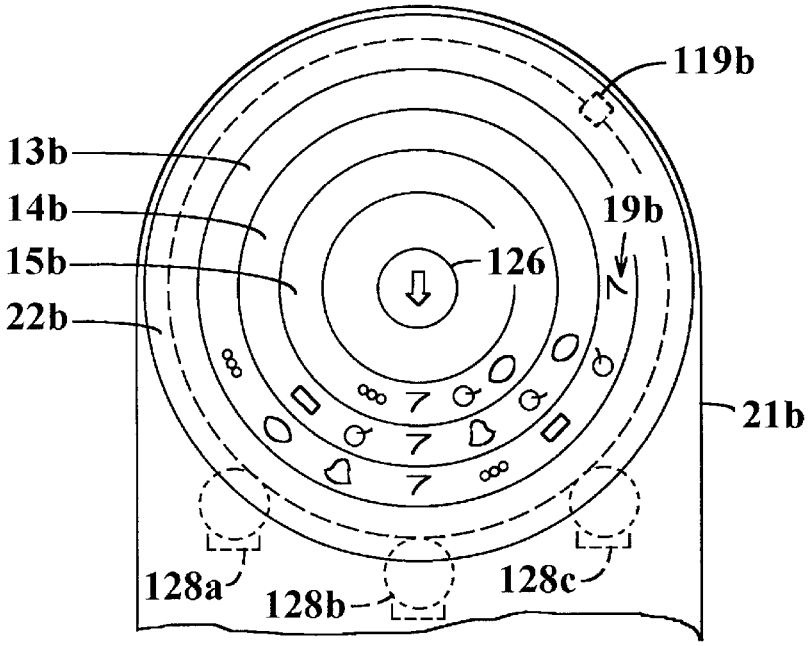
FIG. 9 is a front elevation view of the upper portion of a third embodiment of the invention.
Figure 10:
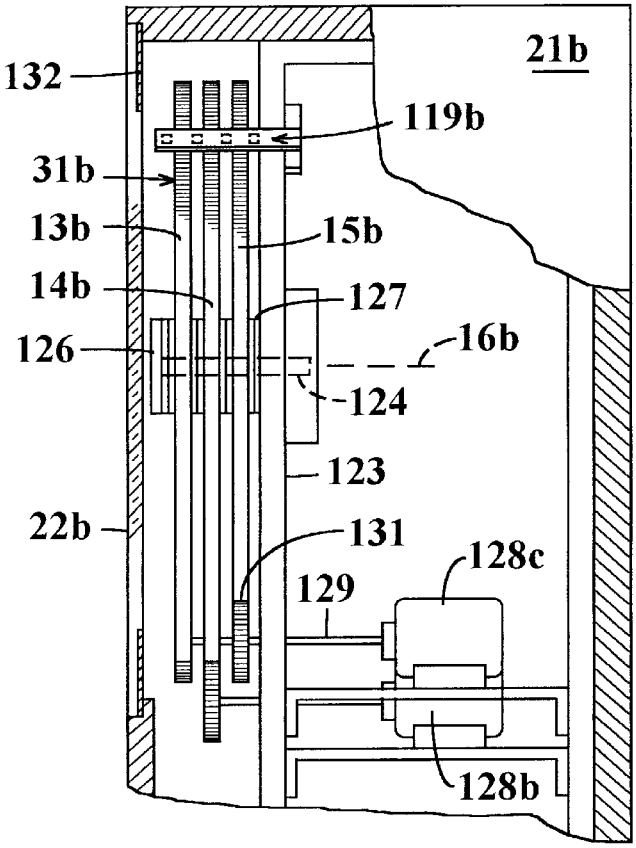
FIG. 10 is a broken out side view of the upper portion of the third embodiment of the invention.

In the embodiment of the invention which has been described with reference to FIGS. 1 to 6, visibility of indicia on disks which are behind other disks is provided for by using disks which are open centered except for the rear disk. In the embodiment which has been described with reference to FIGS. 7 and 8, visibility of the successive bands of indicia is provided for by using disks of progressively greater diameter. Referring jointly to FIGS. 9 and 10, visibility of the bands of indicia can also be realized in a construction where the rotatable disks 13*b,* 14*b* and 15*b* have the same outside diameter and are not necessarily open centered. An advantage of disks which have the same diameter is that they may then be driven by simple gearing situated at the periphery of the disks.

Disks 13*b,* 14*b* and 15*b* carry annular bands of indicia 19*b* of progressively smaller diameter and which may be of the previously described kind. The front disk 13*b,* intermediate disk 14*b* and rear disk 15*b* each have gear teeth 31*b* at the peripheries of the disk. Disks 13*b,* 14*b* and 15*b* are supported by a vertically extending internal frame member 123 within the slot machine cabinet 21*b* and are positioned to be viewable through the transparent front window 22*b* of the cabinet. In particular, an axle 124 extends forward from frame member 124 through the centers of the disks 13*b,* 14*b* and 15*b* and has a flange 126 at its forward end which acts to retain the disks on the axle. Each of the disks 13*b,* 14*b* and 15*b* is rotatable about axle 124 and preferably a pair of thin, flat annular shims 127 encircle the axle between the disks, between front disk 13*b* and flange 126 and between rear disk 15*b* and frame member 124 to create a small spacing between these components.

Disks 13*b,* 14*b* and 15*b* are each driven by a separate electrical motor 128*a,* 128*b* and 128*c* respectively which motors are similar to the drive motors of the previously described embodiments of the invention. Each such motor 128*a,* 128*b* and 128*c* turns a shaft 129 that extends in a direction parallel to the axis of rotation 16*b* of the disks and which has a spur gear 131 at its forward end which engages the gear teeth 31*b* of the particular disk 13*b,* 14*b* and 15*b* that is driven by the particular motor. In this example, motor 128*b* which drives the intermediate disk 14*b* is situated directly below the axis of rotation 16*b* of the disks. Motor 128*b* which drives the front disk 13*b* and motor 128*c* which drives the rear disk 15*b* are at opposite sides of the axis of rotation 16*b* and at a higher elevation.

Photoelectric sensors 119*b* for producing signals that track rotation of the disks 13*b,* 14*b,* 15*b* in the previously described manner do not necessarily require timer plates of the previously described kind if the gear teeth 31*b* of the disks are formed of opaque material or if the teeth have an opaque coating. The sensors 119*b* may simply be positioned to direct light towards the gear teeth 31*b* and to respond to transmission of light through the openings between successive gear teeth.

Appearance of the slot machine can be enhanced by providing an opaque mask 132 on the cabinet window 22*b* that is configured to conceal the peripheral regions of the disks 13*b,* 14*b,* 15*b* at which the gear teeth 31*b* are located.

The annular bands of indicia 19*b* of the successive disks 13*b,* 14*b* and 15*b* are of progressively increasing diameter in this embodiment but can be of progressively diminishing diameter in other embodiments. In either case, viewing of each of the bands of indicia 19*b* is enabled by forming the disks of transparent material such as transparent plastic or at least the regions of the front disk 13*b* and intermediate disk 14*b* that are in front of a band of indicia of another disk are formed of such material.

Except as herein described, the slot machine of FIGS. 9 and 10 may be similar to the embodiment of the invention which has been previously described with reference to FIGS. 1 to 6.

The embodiments of the invention which have been herein described for purposes of example have rotating disks which extend in vertical planes. The disks and disk drive and support systems can be reoriented so that the disks extend in horizontal planes or have an inclined orientation.

The herein described examples of the invention are slot machines of the type used in gambling casinos that require insertion of coins or paper currency and which pay monetary rewards to successful players. The apparatus can also be configured as an amusement device that does not require nor pay out money and wherein the player or players simply earn points when particular indicia come to rest at particular locations or align in particular combinations at such locations.

While the invention has been described with respect to certain specific embodiments for purposes of example, many modifications and variations are possible and it is not intended to limit the invention except as defined in the following claims.

What is claimed is:

1. Gaming apparatus having a plurality of rotatable disks which are centered on a common axis of rotation, each of said rotatable disks being separately rotatable about said axis of rotation, each of said rotatable disks having an annular band of indicia thereon which encircles said axis of rotation and wherein a player's score is determined by arrival of particular indicia at particular locations following a period of rotation of said rotatable disks, said annular band of indicia of each of said rotatable disks being on a face of the rotatable disk which extends inward towards said axis of rotation, wherein the improvement comprises:

each of said rotatable disks having a peripheral region which is of greater diameter than the band of indicia thereon and each of said rotatable disks having an annular band of gear teeth at said peripheral region thereof which band of gear teeth is centered on said axis of rotation, further including a plurality of drive gears each being engaged with said band of gear teeth of a separate one of said rotatable disks, and a plurality of drive motors each being coupled to a separate one of said drive gears to turn the drive gear.

2. The apparatus of claim 1 wherein said drive gears are components of a plurality of disk positioning gear sets situated at the peripheries of the rotatable disks at angular intervals around said axis of rotation thereof, each of said gear sets having a motor driven shaft driven by a separate one of said drive motors with a separate one of said drive gears being on the shaft and being rotated thereby and wherein the driven shafts extend in parallel relationship with said axis of rotation, each of said gear sets further including a plurality of idler gears on the driven shaft which are rotatable relative to the shaft and wherein said idler gears engage said gear teeth of ones of said rotatable disks that are not engaged by the drive gear of the gear set thereby enabling the gear sets to support and position said rotatable disks in addition to driving said rotatable disks.

3. The apparatus of claim 2 wherein said gear sets are situated at angular intervals around said axis of rotation that are less than 180°.

4. The apparatus of claim 2 wherein said annular bands of gear teeth of each of said rotatable disks have equal diameters and wherein said drive gears and idler gears of each of said gear sets have equal diameters.

5. The apparatus of claim 2 wherein said rotatable disks and gear sets and drive motors are disposed within a slot machine cabinet, further including a front structural member situated in front of said rotatable disks and having an opening of sufficient size to enable viewing of said bands of indicia by a player situated in front of said cabinet, a rear structural member situated behind said rotatable disks and having said drive motors attached thereto, and wherein said gear sets extend between said front and rear structural members and are supported thereby, and at least one connector member joining said front and rear structural members whereby said rotatable disks and gear sets and drive motors are unitized and are removable from said cabinet as a unit.

6. The apparatus of claim 1 wherein said rotatable disks include at least a first, second and third rotatable disk wherein said faces of said disks having said bands of indicia thereon are spaced apart in the direction of said axis of rotation.

7. The apparatus of claim 6 wherein said annular bands of indicia of said first, second and third disks are of progressively smaller diameter, said first rotatable disk having an open center of sufficient size to enable viewing of said annular bands of indicia of said second and third rotatable disks, said second rotatable disk having a smaller open center of sufficient size to enable viewing of said annular band of indicia of said third rotatable disk.

8. The apparatus of claim 1 wherein said rotatable disks include at least a first, second and third rotatable disk wherein said faces of said disks having said bands of indicia thereon are spaced apart in the direction of said axis of rotation, and wherein said annular bands of indicia of said first, second and third disks are of progressively smaller diameter, said first rotatable disk having an open center of sufficient size to enable viewing of said annular bands of indicia of said second and third rotatable disks, said second rotatable disk having a smaller open center of sufficient size to enable viewing of said annular band of indicia of said third rotatable disk, and wherein said drive gears are components of a plurality of disk positioning gear sets situated at the peripheries of the rotatable disks at angular intervals around said axis of rotation thereof, each of said gear sets having a motor driven shaft driven by a separate one of said drive motors with a separate one of said drive gears being on the shaft and being rotated thereby and wherein the driven shafts extend in parallel relationship with said axis of rotation, each of said gear sets further including a plurality of idler gears on the driven shaft which are rotatable relative to the shaft and wherein said idler gears engage said gear teeth of ones of said rotatable disks that are not engaged by the drive gear of the gear set thereby enabling the gear sets to support and position said rotatable disks in addition to driving said rotatable disks.

9. The apparatus of claim 1 further comprising a member disposed in front of said rotatable disks in position to conceal said band of gear teeth of each of said rotatable disks and having a circular opening therein which is centered on said axis of rotation, said circular opening being proportioned to enable viewing of said annular band of indicia of each of said rotatable members.

10. The apparatus of claim 1 further including photoelectric means for generating electrical pulses indicative of increments of rotation of said rotatable disks, said photoelectric means being positioned to be responsive to passage of said gear teeth of said rotatable disks between light sources and light detectors.

11. The apparatus of claim 1 wherein said rotatable disks include at least a first, a second and a third rotatable disk whereon the annular bands of indicia are of differing diameters, at least the portions of said rotatable disks at which said annular bands of indicia are located being formed of material which is at least partially light transmissive, further including first, second and third circular strobe lights disposed behind said rotatable disks and being centered on said axis of rotation, said first, second and third circular strobe lights respectively having diameters corresponding to the diameters of said first, second and third rotatable disks.

12. The apparatus of claim 1 wherein said annular bands of indicia of said rotatable members are of differing diameters and wherein a first of said rotatable disks is situated in front of a second of said rotatable disks and overlays the annular band of indicia of a second of said rotatable disks and wherein said second of said rotatable disks is situated in front of a third of said rotatable disks and overlays the annular band of indicia of said third of said rotatable disks, at least the portions of each rotatable member that overlay the annular band of indicia of another rotatable member being formed of transparent material.

13. The apparatus of claim 12 wherein rotatable disks are transparent disks of equal diameter.

14. Gaming apparatus having a plurality of rotatable disks which are centered on a common axis of rotation, each of said rotatable disks being separately rotatable about said axis of rotation, each of said rotatable disks having an annular band of indicia thereon which encircles said axis of rotation and wherein a player's score is determined by arrival of particular indicia at particular locations following a period of rotation of said rotatable disks, said annular band of indicia of each of said rotatable disks being on a face of the rotatable disk which extends inward towards said axis of rotation, said rotatable disks each being supported by a separate one of a plurality of telescoped drive shafts which extend along said axis of rotation and wherein a separate drive motor is coupled to each of said drive shafts, wherein the improvement comprises:

said faces of said rotatable disks at which said bands of indicia are located being spaced apart in a direction parallel to said axis of rotation.

15. The apparatus of claim 14 wherein said faces of said rotatable disks at which said bands of indicia are located are beveled peripheral surfaces of said disks.

16. The apparatus of claim 14 wherein said rotatable disks are flat plates which extend radially outward from said telescoped drive shafts and include at least a first disk which is in front of a second disk and a third disk which is behind said second disk, said first second and third disks being of progressively greater diameter enabling viewing of a radially outermost region of each of said disks, said faces of said disks at which said annular bands of indicia are located being said radially outermost regions of said disks.

17. Gaming apparatus having a plurality of rotatable disks which are centered on a common axis of rotation, each of said rotatable disks being separately rotatable about said axis of rotation, each of said rotatable disks having an annular band of indicia thereon which encircles said axis of rotation and wherein a player's score is determined by arrival of particular indicia at particular locations following a period of rotation of said rotatable disks, said annular band of indicia of each of said rotatable disks being of differing diameters being on faces of the rotatable disks which extends inward towards said axis of rotation, wherein the improvement comprises:

a first of said rotatable disks being situated in front of the annular band of indicia of a second of said rotatable disks and wherein said second of said rotatable disks is situated in front of the annular band of indicia of a third of said rotatable disks, at least the portions of each rotatable disk that are in front of the annular band of indicia of another rotatable disk being formed of transparent material.

* * * * *

UNITED STATES PATENT AND TRADEMARK OFFICE

CERTIFICATE OF CORRECTION

PATENT NO : 6,105,962

DATED : August 22, 2000

INVENTOR(S) : Alex J. Malavazos, et al.

It is certified that error appears in the above-identified patent and that said Letters Patent are hereby corrected as shown below:

On title page, item 75 Inventors
replace "Alex J. Malavazos, Gregory A. Malavazos, Constantine Malavazos"
with --Robert A. Luciano, Alex J. Malavazos, Gregory A. Malavazos, Constantine Malavazos --.

Signed and Sealed this

First Day of May, 2001

*Attest:*

Nicholas P. Godici

NICHOLAS P. GODICI

*Attesting Officer*

*Acting Director of the United States Patent and Trademark Office*